US011066779B2

(12) United States Patent
Kim et al.

(10) Patent No.: US 11,066,779 B2
(45) Date of Patent: Jul. 20, 2021

(54) CLOTHES DRYER

(71) Applicant: SAMSUNG ELECTRONICS CO., LTD., Suwon-si (KR)

(72) Inventors: Da Eun Kim, Seoul (KR); Yong Soon Park, Seoul (KR); Bum Jang, Seoul (KR); Seung Eun Chung, Yongin-si (KR); Jin Young Choi, Seongnam-si (KR)

(73) Assignee: SAMSUNG ELECTRONICS CO., LTD, Suwon-si (KR)

( * ) Notice: Subject to any disclaimer, the term of this patent is extended or adjusted under 35 U.S.C. 154(b) by 129 days.

(21) Appl. No.: 16/467,782

(22) PCT Filed: Nov. 13, 2017

(86) PCT No.: PCT/KR2017/012774
§ 371 (c)(1),
(2) Date: Jun. 7, 2019

(87) PCT Pub. No.: WO2018/105909
PCT Pub. Date: Jun. 14, 2018

(65) Prior Publication Data

US 2020/0063330 A1 Feb. 27, 2020

(30) Foreign Application Priority Data

Dec. 8, 2016 (KR) ..... 10-2016-0166322

(51) Int. Cl.
*F26B 21/06* (2006.01)
*D06F 58/26* (2006.01)
(Continued)

(52) U.S. Cl.
CPC ..... *D06F 58/266* (2013.01); *D06F 58/04* (2013.01); *D06F 58/10* (2013.01); *D06F 58/16* (2013.01);
(Continued)

(58) Field of Classification Search
CPC ..... D06F 58/266; D06F 58/30; D06F 58/04; D06F 58/10; D06F 58/16; D06F 58/20;
(Continued)

(56) References Cited

U.S. PATENT DOCUMENTS 8,826,561 B2 * 9/2014 Wisherd ..... D06F 58/26 34/255
2009/0119945 A1 * 5/2009 Bari ..... D06F 58/20 34/543
(Continued)

FOREIGN PATENT DOCUMENTS

CN 101405448 4/2009
CN 104955998 9/2015
(Continued)

OTHER PUBLICATIONS

Extended European Search Report dated Oct. 7, 2019 in European Patent Application No. 17877735.5.
(Continued)

*Primary Examiner* — John P McCormack
(74) *Attorney, Agent, or Firm* — Staas & Halsey LLP

(57) ABSTRACT

A clothes dryer comprises a body, a first drying container installed in the body and configured to include a rotary drum configured to be rotatable, and a second drying container installed in the body but separated from the first drying container, and the second drying container includes an electrode plate configured to include a plurality of electrode regions, a controller configured to select an electrode region where an electric field is to be applied, among the plurality of electrode regions and an electric field is applied to the electrode region selected by the controller.

14 Claims, 16 Drawing Sheets

(51) Int. Cl.

| | |
|---|---|
| ***D06F 58/30*** | (2020.01) |
| ***D06F 58/04*** | (2006.01) |
| ***D06F 58/10*** | (2006.01) |
| ***D06F 58/16*** | (2006.01) |
| *D06F 103/00* | (2020.01) |
| *D06F 105/28* | (2020.01) |

(52) U.S. Cl.
CPC ..... *D06F 58/30* (2020.02); *D06F 2103/00* (2020.02); *D06F 2105/28* (2020.02)

(58) Field of Classification Search
CPC .. D06F 58/26; D06F 2103/00; D06F 2105/28; D06F 29/005; H05B 6/80
USPC ..... 34/535, 250, 255, 259
See application file for complete search history.

(56) References Cited

U.S. PATENT DOCUMENTS

2010/0038752 A1* 2/2010 Ng ..... H01G 4/01 257/532
2014/0053727 A1* 2/2014 Miller ..... B03C 3/366 95/78
2015/0052774 A1* 2/2015 Herman ..... D06F 58/30 34/255
2015/0052775 A1 2/2015 Herman et al.
2015/0089829 A1 4/2015 Herman et al.
2016/0130743 A1 5/2016 Wisherd et al.

FOREIGN PATENT DOCUMENTS

EP 1 835 066 A1 9/2007
KR 10-2015-0103372 9/2015
KR 10-2016-0131901 11/2016
KR 10-2016-0132765 11/2016

OTHER PUBLICATIONS

International Search Report dated Feb. 22, 2018 in corresponding International Application No. PCT/KR2017/012774, 5 pages.
Written Opinion of the International Searching Authority dated Feb. 22, 2018 in corresponding International Application No. PCT/KR2017/012774, 6 pages.
Chinese Office Action dated Dec. 22, 2020 from Chinese Application No. 201780084355.5, 24 pages.

* cited by examiner

CLOTHES DRYER

CROSS-REFERENCE TO RELATED APPLICATIONS

This application is a U.S. National Stage Application which claims the benefit under 35 U.S.C. § 371 of International Patent Application No. PCT/KR2017/012774 filed on Nov. 13, 2017, which claims foreign priority benefit under 35 U.S.C. § 119 of Korean Patent Application No. 10-2016-0166322 filed on Dec. 8, 2016 in the Korean Intellectual Property Office, the contents of both of which are incorporated herein by reference.

TECHNICAL FIELD

The present disclosure relates to a clothes dryer.

BACKGROUND ART

Generally, a clothes dryer is an apparatus that dries an object to be dried in a drum by allowing hot air to pass through the drum while rotating the drum containing the object to be dried at a low speed.

The clothes dryer may include a drum configured to accommodate objects to be dried therein and rotatably installed, a driver configured to drive the drum, a blower configured to blow air into the rotating drum, an air supply flow path configured to guide air to the drum, and an air discharge flow path configured to guide air discharged from the drum.

When the clothes dryer is operated after the object to be dried is put into the drum, the drum is rotated by the operation of the driver, and air is blown into the drum by the operation of the blower. Therefore, the object to be dried in the drum repeatedly is dropped or raised by the rotation of the drum and the object to be dried may be quickly dried by the hot air.

For the purpose of improving the drying performance of such a hot air type clothes dryer, a method using electromagnetic waves such as microwaves has been applied to clothes dryers. A drying method using electromagnetic waves employs a dielectric heating and the dielectric heating uses frictional heat loss that is generated by a vibration of component molecules such as ions and dipoles in a dielectric by applying an electric field to the dielectric. In comparison with the conventional hot air drying method, the drying method using the electromagnetic waves has relatively high dry energy efficiency and a temperature of the object to be dried is not excessively increased, thereby preventing damage in the object to be dried.

DISCLOSURE

Technical Problem

The present disclosure is directed to providing a clothes dryer using an electromagnetic wave, the clothes dryer capable of selecting a region where an electric field is to be applied, according to a dry state and a volume of an object to be dried.

Further, the present disclosure is directed to providing a clothes dryer capable of adjusting an intensity of an electric field applied to an object to be dried according to a dry state and a volume of the object to be dried.

Technical Solution

One aspect of the present disclosure provides a clothes dryer including a body, a first drying container installed in the body and configured to include a rotary drum configured to be rotatable, and a second drying container installed in the body but separated from the first drying container, and the second drying container includes an electrode plate configured to include a plurality of electrode regions, a controller configured to select an electrode region where an electric field is to be applied, among the plurality of electrode regions and an electric field is applied to the electrode region selected by the controller.

The electrode plate may include a first electrode plate and a second electrode plate, and the first electrode plate may be installed on one surface of the second drying container, and the second electrode plate may be installed on other surface of the second drying container facing the first electrode plate.

The second drying container may further include a door configured to open and close an inlet formed in an upper surface of the second drying container, and the first electrode plate may be installed on a lower surface of the door, and the second electrode plate may be installed on an upper surface of a lower portion of the second drying container.

The first electrode plate may be formed of cathodes and the second electrode plate may be formed of anodes.

The electrode plate may include a first electrode region arranged in a center portion of the electrode plate and a second electrode region surrounding an outside of the first electrode region.

The second drying container may further include an impedance detector configured to detect an impedance of the plurality of electrode regions, and the controller may select an electrode region where an electric field is to be applied, based on the impedance of the plurality of electrode regions.

The electrode plate may include a first electrode region arranged in a center portion of the electrode plate and a second electrode region surrounding an outside of the first electrode region, and the controller may allow the electric field applier to apply an electric field to the first electrode region when a capacitance of the first electrode region is less than a predetermined reference value, and the controller may allow the electric field applier to apply an electric field to the first electrode region and the second electrode region when a capacitance of the second electrode region is less than the predetermined reference value.

The clothes dryer may further include a control panel configured to receive a command for applying an electric field to at least one electrode region among the plurality of electrode regions, from a user, and the controller may select an electrode region where an electric field is to be applied, based on the electric field application command.

The second drying container may further include an electrode plate mover configured to move the electrode plate.

The second drying container may further include an impedance detector configured to detect an impedance of the electrode plate, and the controller may control the electrode plate mover based on a value detected by the impedance detector.

The electrode plate may include a first electrode plate installed on one surface of the second drying container and a second electrode plate installed on other surface of the second drying container facing the first electrode plate, and the controller may control an electrode plate mover wherein a distance between the first electrode plate and the second electrode plate is adjusted based on a value detected by the impedance detector.

The clothes dryer may further include a control panel configured to receive an electrode plate movement command, from a user, and the controller may allow the electrode plate mover to move the electrode plate based on the electrode plate movement command.

The electrode plate may include a plurality of holes.

The electrode plate may be installed on a side surface of the second drying container.

The electrode plate may include a plurality of electrode plates configured to divide an empty space of the second drying container into a plurality of regions.

The plurality of electrode plates may be formed in the form of a propeller with respect to an upper surface of the second drying container.

The plurality of electrode plates may include a first electrode plate formed of cathodes and a second electrode plate formed of anodes.

The plurality of electrode plates may rotate in the second drying container.

The second drying container may further include a plurality of racks in the form of bellows, and an electrode plate may be installed on at least one rack among the plurality of racks.

The plurality of electrode plates may include a first electrode plate installed on one rack and formed of cathodes and a second electrode plate installed on other rack and formed of anodes.

The electrode plate may be manually or automatically foldable by a control signal of the controller.

Another aspect of the present disclosure provides a clothes dryer including a body, a first drying container installed in the body and configured to include a rotary drum configured to be rotatable, and a second drying container installed in the body but separated from the first drying container, and the second drying container includes a plurality of electrode plates, an electric field applier configured to apply an electric field to the plurality of electrode plates, an impedance detector configured to detect an impedance of the plurality of electrode plates, an electrode plate mover configured to move the plurality of electrode plates, and a controller configured to allow the electrode plate mover to move the plurality of electrode plates based on the detected impedance.

The electrode plate may include a first electrode plate and a second electrode plate, and the first electrode plate may be installed on one surface of the second drying container, and the second electrode plate may be installed on other surface of the second drying container facing the first electrode plate.

Advantageous Effects

It may be possible to increase efficiency of power consumption by selectively applying an electric field to each region according to a drying state or a volume of an object to be dried.

It may be possible to minimize damage in a part, which is already dried, in an object to be dried by applying or not applying an electric field to an electrode region corresponding to each part of the object to be dried.

By moving an electrode plate according to a drying state or a volume of the object to be dried, it may be possible to adjust an intensity of the electric field to be applied to an object to be dried and it may be possible to optimize the intensity of the electric field to be applied to the object to be dried. Therefore, it may be possible to secure quick-drying performance.

MODES FOR THE INVENTION

Figure 1:
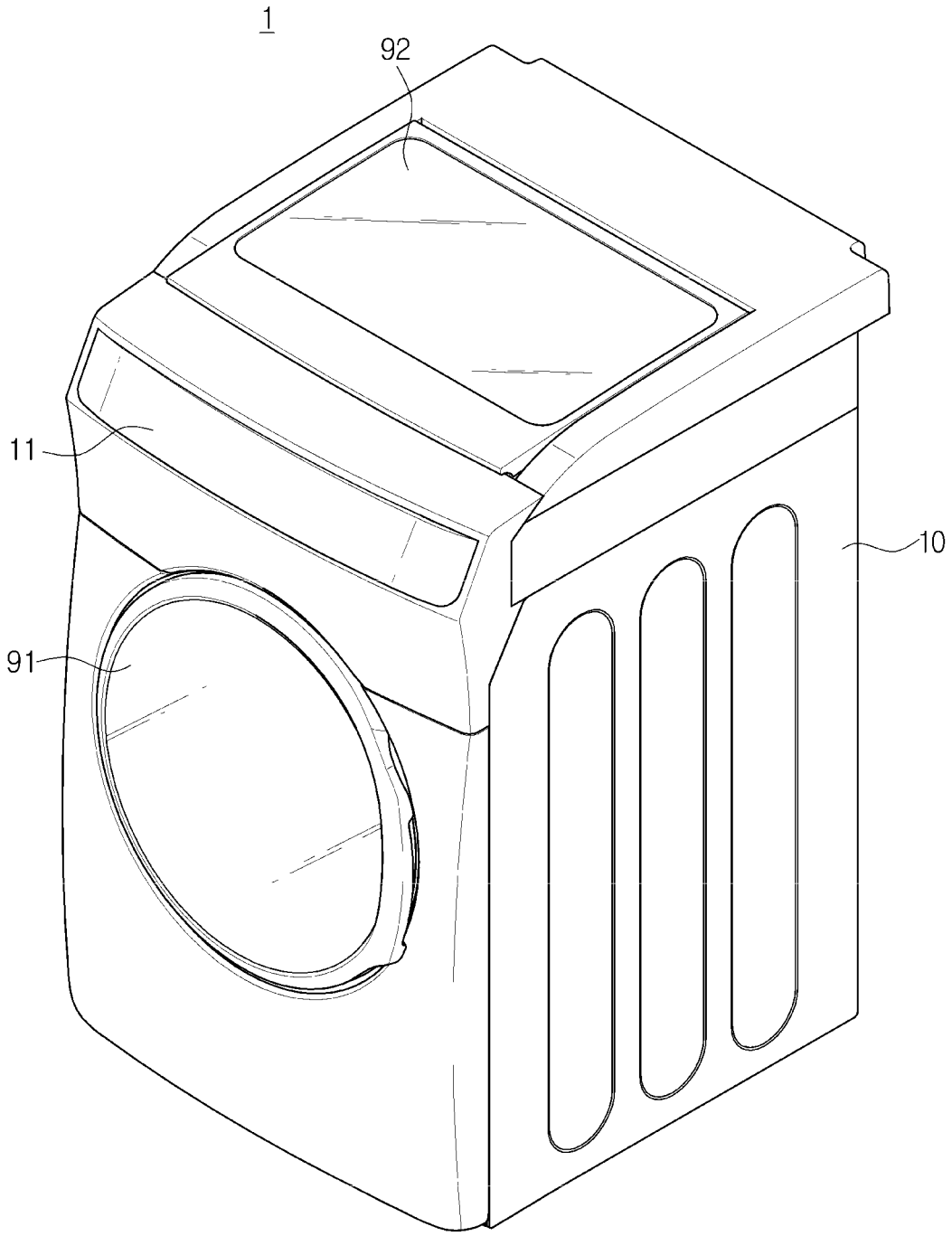
FIG. 1 is a view of an exterior of a clothes dryer according to one embodiment of the present disclosure.

In the following description, like reference numerals refer to like elements throughout the specification. Well-known functions or constructions are not described in detail since they would obscure the one or more exemplar embodiments with unnecessary detail. Terms such as "unit", "module", "member", and "block" may be embodied as hardware or software. According to embodiments, a plurality of "unit", "module", "member", and "block" may be implemented as a single component or a single "unit", "module", "member", and "block" may include a plurality of components.

Also, when a part "includes" or "comprises" an element, unless there is a particular description contrary thereto, the part may further include other elements, not excluding the other elements.

Throughout the description, when a member is "on" another member, this includes not only when the member is in contact with the other member, but also when there is another member between the two members.

It will be understood that, although the terms first, second, third, etc., may be used herein to describe various elements, but is should not be limited by these terms. These terms are only used to distinguish one element from another element.

As used herein, the singular forms "a," "an" and "the" are intended to include the plural forms as well, unless the context clearly indicates otherwise.

Reference will now be made in detail to embodiments of the present disclosure, examples of which are illustrated in the accompanying drawings.

Figure 2:
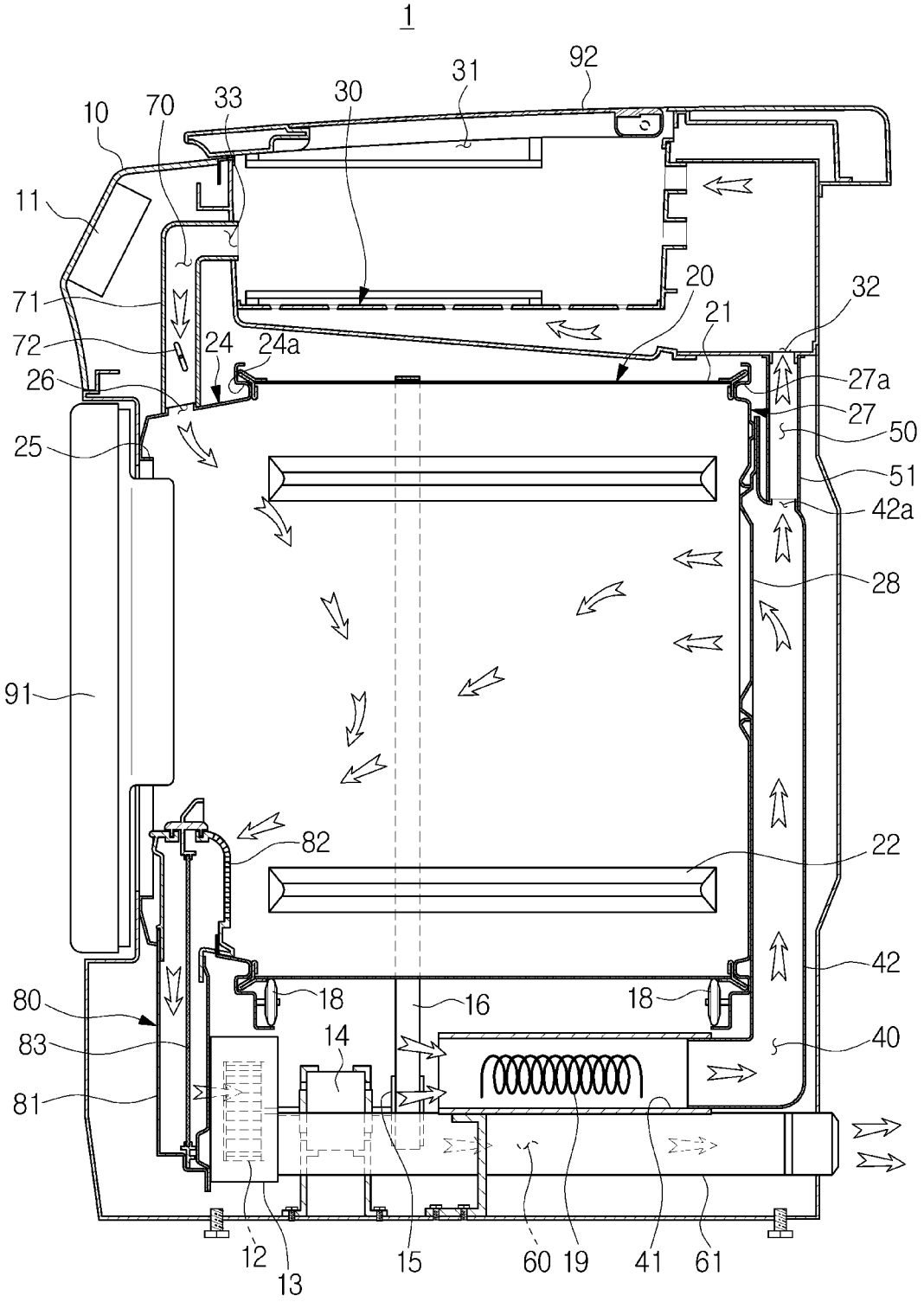
FIG. 2 is a side cross-sectional view schematically illustrating a main configuration of the clothes dryer of FIG. 1.
Figure 3:
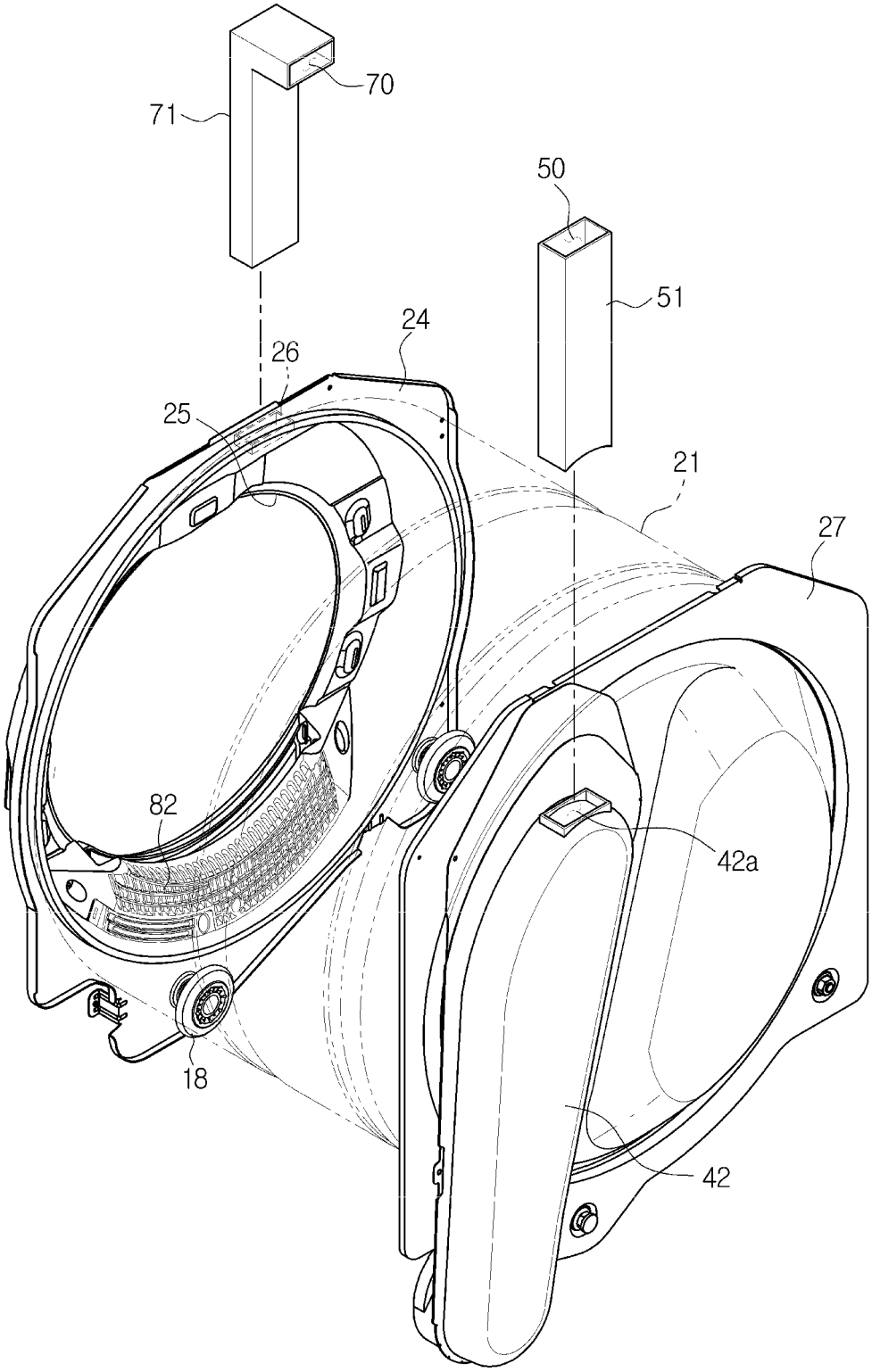
FIG. 3 is a view of an inlet duct and an outlet duct of the clothes dryer of FIG. 1.

FIG. 1 is a view of an exterior of a clothes dryer according to one embodiment of the present disclosure. FIG. 2 is a side cross-sectional view schematically illustrating a main configuration of the clothes dryer of FIG. 1. FIG. 3 is a view of an inlet duct and an outlet duct of the clothes dryer of FIG. 1.

According to one embodiment, a clothes dryer 1 includes a body 10 forming an exterior thereof, first and second drying containers 20 and 30 installed in the body 10 to receive an object to be dried, a blowing fan 12 configured to blow air to the first drying container 20 and the second drying container 30, and a heater 19 configured to heat air to be supplied to the first drying container 20 and the second drying container 30.

The body 10 may have a substantially box shape. A first door 91 configured to open and close a first inlet 25 of the first drying container 20 may be installed on a front surface of the body 10. The first door 91 may be rotatably coupled to the body 10. A second door 92 configured to open and close a second inlet 31 of the second drying container 30 may be installed on upper surface of the body 10. A control panel 11 configured to display a variety of information related to the clothes dryer 1 or configured to receive an operation command may be installed on a front upper portion of the body 10.

In order to display information, the control panel 11 may be implemented with a cathode ray tube (CRT), a digital light processing (DLP) panel, a plasma display pane, a liquid crystal display (LCD) panel, an electro luminescence (EL) panel, an electrophoretic display (EPD) panel, an electrochromic display (ECD) panel, a light emitting diode (LED) panel, or an organic light emitting diode (OLED), but is not limited thereto.

In addition, in order to receive an input of an operation command, the control panel 11 may include a graphical user interface (GUI) that is a software device, such as a touch pad. The touch pad may be implemented as a touch screen panel (TSP).

The first drying container 20 may dry an object to be dried in a rotating manner. The first drying container 20 may include a rotary drum 21 formed in the form of cylinder having an upper surface thereof and a lower surface thereof open and configured to be rotatable, and a front support plate 24 and a rear support plate 27 configured to support the rotary drum 21.

The front support plate 24 may include a front support 24*a* configured to support a front end portion of the rotary drum 21, a first inlet 25 configured to allow an object, which is to be dried, to be input into the inside of the first drying container 20, and a connection port 26 through which air of the second drying container 30 flows.

The rear support plate 27 may include a rear support 27*a* configured to support a rear end portion of the rotary drum 21, and an intake port 28 through which external air flows to the inside of the first drying container 20.

A roller 18 configured to support the rotary drum 21 to allow the rotary drum 21 to smoothly rotate may be installed under the rotary drum 21. A lifter 22 configured to raise an object to be dried may be installed on an inner circumferential surface of the rotary drum 21.

The clothes dryer 1 may include a drive motor 14 configured to generate a driving force and the driving force may rotate the rotary drum 21 while operating the blowing fan 12. One end of a rotating shaft of the drive motor 14 may be connected to the blowing fan 12 and the other end of the rotating shaft may be connected to a pulley 15. An outer surface of the pulley 15 and an outer surface of the rotary drum 21 are connected by a belt 16, and thus the driving force of the drive motor 14 may be transmitted to the rotary drum 21.

The second drying container 30 may be provided on the upper side of the first drying container 20. The second drying container 30 may dry the object to be dried in a non-rotating manner. That is, the second drying container 30 may be maintained in a fixed state without the rotation.

The size of the second drying container 30 may be smaller than that of the first drying container 20. Therefore, an amount of objects to be dried in the second drying container 30 may be less than an amount of objects to be dried in the first drying container 20.

The second drying container 30 includes a second inlet 31 configured to allow an object, which is to be dried, to be input into the inside of the second drying container 30, and the second inlet 31 may be formed on an upper surface of the second drying container 30. Further, the second drying container 30 may include an intake port 32 through which external air flows, and a discharge port 33 through which air of the second drying container 30 is discharged to the outside.

The clothes dryer 1 may include a first supply flow path 40 configured to supply air to the first drying container 20, a second supply flow path 50 branched from the first supply flow path 40 to supply air to the second drying container 30, a first discharge flow path 60 configured to discharge air of the first drying container 20, and a second discharge flow path 70 configured to allow the air of the second drying container 30 to pass through the first drying container 20 and discharged.

The first supply flow path 40 may be formed by supply ducts 41 and 42. The ducts 41 and 42 may include a lower supply duct 41 installed approximately under the first drying container 20, and a rear supply duct 42 installed such that one end thereof is connected to the lower supply duct 41 and the other end thereof is connected to the intake port 28 of the first drying container 20. The heater 19 is installed on the first supply flow path 40 to heat air flowing in the first supply flow path 40.

The second supply flow path 50 may be formed by an inlet duct 51. The inlet duct 51 may connect a branched port 42*a* of the supply duct 42 to the intake port 32 of the second drying container 30. According to one embodiment, the inlet duct 51 and the supply duct 42 are separated from each other, but the inlet duct 51 and the supply duct 42 may be integrally formed with each other.

The first discharge flow path 60 may be formed by a filter case 81, a blowing fan case 13 and a discharge duct 61.

The second discharge flow path 70 may be formed by an outlet duct 71. The outlet duct 71 may connect the discharge port 33 of the second drying container 30 to the connection port 26 of the front support plate 24.

With this configuration, when the drive motor 14 is operated, the driving force is transmitted to the rotary drum 21 via the pulley 15 and the belt 16, thereby rotating the rotary drum 21.

Further, the driving force generated in the drive motor 14 may allow air to move by rotating the blowing fan 12. Therefore, external air is supplied to the first drying container 20 and the second drying container 30 via the first supply flow path 40 and the second supply flow path 50, and the air, which becomes moist after drying the object to be dried in the first drying container 20, is discharged through the first discharge flow path 60. The air, which becomes moist after drying the object to be dried in the second drying container 30, is guided to the inside of the first drying container 20 through the second discharge flow path 70 and finally discharged through the first discharge flow path 60.

A filter 80 configured to filter out foreign substances in the air discharged through the first discharge flow path 60 may be mounted under the front support plate 24. The filter 80 may include the filter case 81, a grill 82 formed on one side of the filter case 81, and a filter member 83 installed in the filter case 81.

Alternatively, when the drive motor 14 is operated, air may be supplied to the first drying container 30 without being supplied to the second drying container 30. For this, a shutter 72 may be installed in the second discharge flow path 70 guiding the air of the second drying container 30 to the first drying container 20.

That is, in order to perform drying using the first drying container 20 and the second drying container 30, the shutter 72 may be opened to supply air to both of the first drying container 20 and the second drying container 30. Alternatively, in order to use the first drying container 20 other than the second drying container 30, the shutter 72 may be closed to prevent air from flowing to the second drying container 30.

According to one embodiment, the shutter 72 is provided in the second discharge flow path 70, but is not limited thereto. However, despite of being provided in the second supply flow path 50, the shutter 72 may perform the same function.

As mentioned above, the clothes dryer 1 according to one embodiment includes the first drying container 20 in the rotating manner and the second drying container 30 in the non-rotating manner, and thus a user can selectively apply a rotating type drying or a non-rotating type drying to the object to be dried according to characteristics of the object to be dried.

Further, because hot air is supplied to both the first drying container 20 and the second drying container 30 by the single heater 19 and the single blowing fan 12, an internal structure may be simplified and an available drying space may be increased.

Because the air in the second drying container 30 is not directly discharged, but the air is discharged after passing through the first drying container 20, it may be possible to simplify the structure of the flow path. Further, because the air that passed through the second drying container 30 having a relatively small load is used again without directly being discharged, it may be possible to increase drying efficiency.

Figure 4:
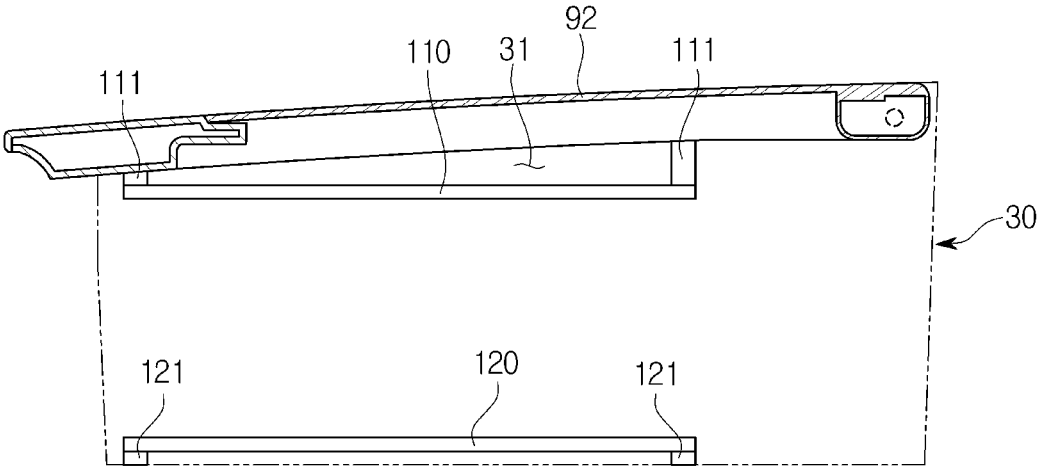
FIG. 4 is a side cross-sectional view of a second drying container of the clothes dryer according to one embodiment of the present disclosure.
Figure 5:
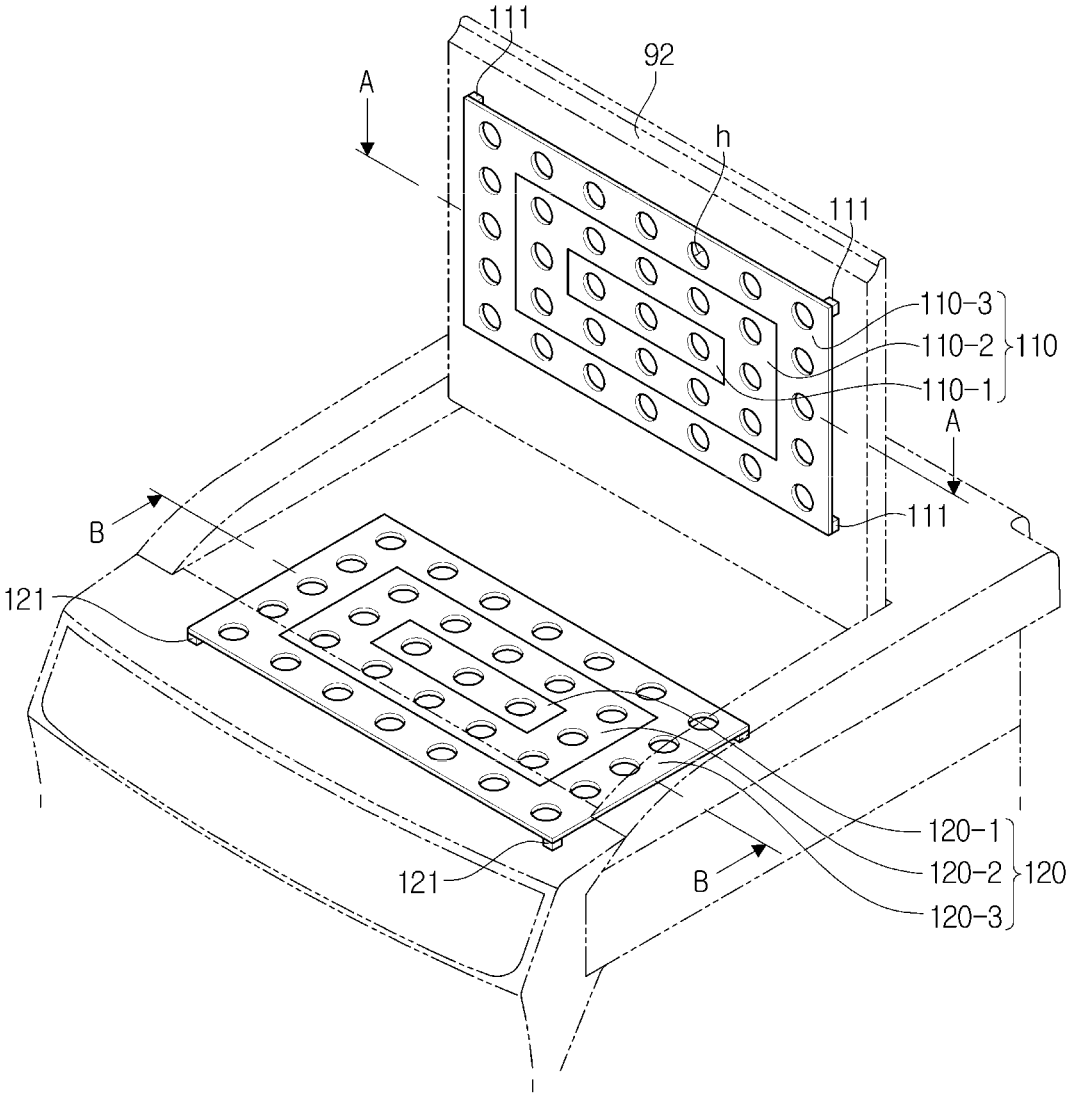
FIG. 5 is a view illustrating a state in which a second door of the clothes dryer is opened.
Figure 6:
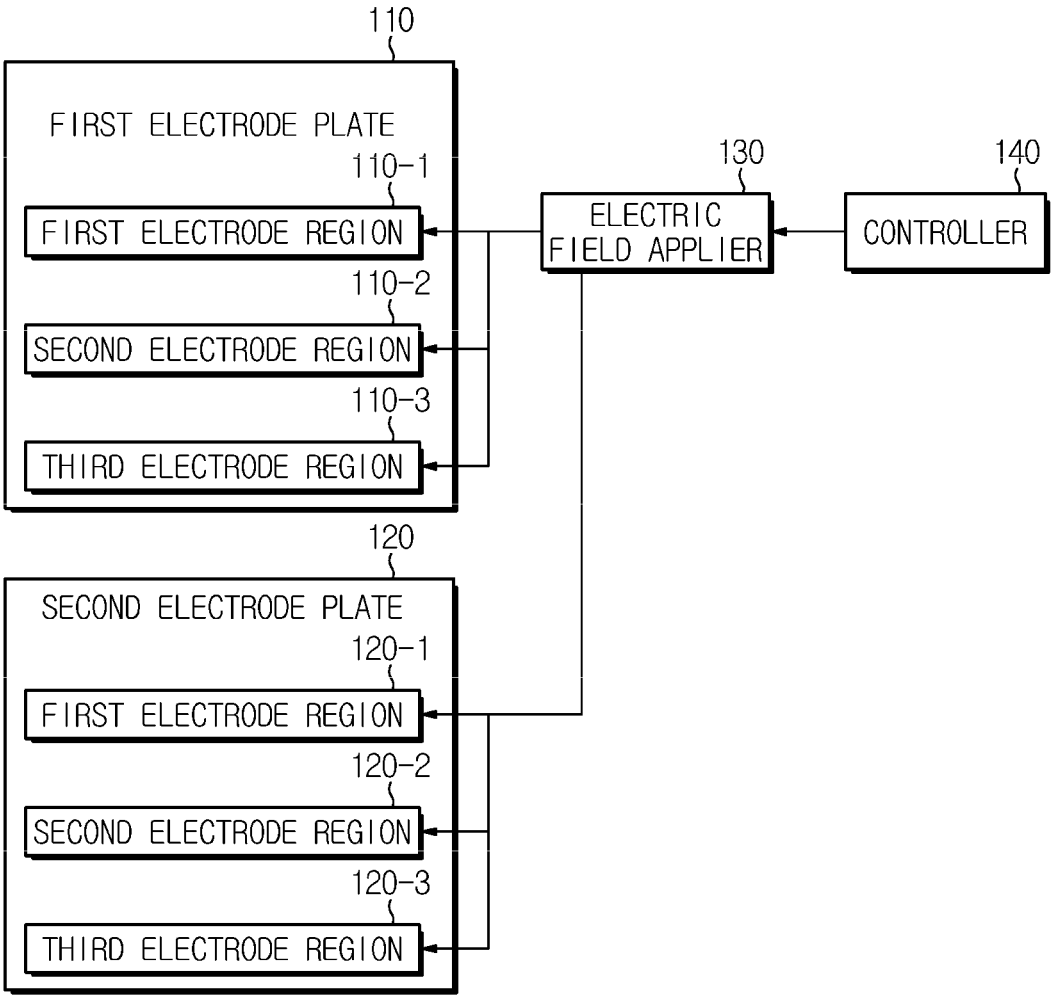
FIG. 6 is a control block diagram of the second drying container of the clothes dryer according to one embodiment of the present disclosure.

FIG. 4 is a side cross-sectional view of a second drying container of the clothes dryer according to one embodiment of the present disclosure, and FIG. 5 is a view illustrating a state in which a second door of the clothes dryer is opened. FIG. 6 is a control block diagram of the second drying container of the clothes dryer according to one embodiment of the present disclosure.

The second drying container 30 of the clothes dryer 1 according to one embodiment will be described with reference to FIGS. 4 to 6.

The second door 92 may be hinged to the body 10. The second door 92 may be coupled to the body 10 to be rotatable about the rotating shaft 93. FIGS. 4 and 5 illustrate that the second door 92 is hinged to the body 10, but the second door 92 may be popped up from the body 10.

According to one embodiment, the clothes dryer 1 includes the first drying container 20 performing drying in the rotating manner and the second drying container 30 performing drying in the non-rotating manner. The second drying container 30 is installed in the upper side of the first drying container 20, and the second inlet 31 of the second drying container 30 is formed on the upper surface of the second drying container 30.

An electrode plate may be installed on at least one of a plurality of surfaces forming the second drying container 30. Hereinafter the second drying container 30 in which a first electrode plate 110 is installed in an upper portion of the second drying container 30 and a second electrode plate 120 is installed in a lower portion of the second drying container 30 will be described as an example. The first electrode plate 110 installed in the upper portion may be provided on a lower surface of the second door 92 and opened and closed together with the second door 92. The second electrode plate 120 installed in the lower portion may be provided on a bottom of the second drying container 30 to face the first electrode plate 110.

By a first spacing portion 111, the first electrode plate 110 may be installed apart from the lower surface of the second door 92 by a certain distance. By a second spacing portion 121, the second electrode plate 120 may be installed apart from an upper surface of the lower portion of the second drying container 30 by a certain distance. Alternatively, the first electrode plate 110 and the second electrode plate 110 may be directly installed without the first spacing portion 111 and the second spacing portion 121.

The first electrode plate 110 may be composed of cathodes and connected to a ground electrode, and the second electrode plate 120 may be composed of anodes and connected to a signal electrode. Because the electrode plate 110 is connected to the ground electrode, it may be possible to reduce the risk of electric shock when a user opens and closes the second door 92.

Referring to FIG. 5, the first electrode plate 110 and the second electrode plate 120 may include a plurality of regions, respectively.

The plurality of regions may include first electrode regions 110-1 and 120-1 arranged at the center of the electrode plates 110 and 120, and second electrode regions 110-2 and 120-2 surrounding the outside of the first electrode regions 110-1 and 120-1, and may further include third electrode regions 110-3 and 120-3 surrounding the outside of the second electrode regions 110-2 and 120-2.

FIG. 4 illustrates the electrode plates 110 and 120 including the first to third electrode regions 110-1 to 110-3, and 120-1 to 120-3 as an example, but the number of electrode regions is not limited thereto.

The first electrode plate 110 and the second electrode plate 120 may include a plurality of holes h. Because the first electrode plate 110 is installed apart from the lower surface of the second door 92 by the first spacing portion 111 and the second electrode plate 120 is installed apart from the bottom surface of the second drying container 30 by the second spacing portion 121, air may flow through the hole h and thus the object to be dried between the first electrode plate 110 and the second electrode plate 110 may be dried.

Referring to FIG. 6, by an electric field applier 130, an electric field may be applied to the plurality of electrode regions 110-1 to 110-3 and 120-1 to 120-3 of the electrode plates 110 and 120.

Based on a control signal of the controller 140, the electric field applier 130 applies a high frequency electric field (for example, microwave) to at least one of regions 110-1 to 110-3 and 120-1 to 120-3 of the electrode plates 110 and 120 corresponding to a dielectric.

When an electric field is applied to the electrode plates 110 and 120, the dielectric heating phenomenon occur using frictional heat loss caused by a vibration of component such as ions and dipoles in the dielectric. Accordingly, the object to be dried in the second drying container 30 is heated and dried.

The controller 140 selects at least one electrode region 110-1 to 110-3 and 120-1 to 120-3 where the electric field is to be applied, and generates a control signal for controlling the electric field applier 130.

As one example, at least one electrode regions 110-1 to 110-3 and 120-1 to 120-3 where the electric field is to be applied may be manually selected by an input. When a user inputs the first electrode regions 110-1 and 120-1 to the control panel 11, the controller 140 may allow the electric field applier 130 to apply the electric field to the first electrode region 110-1 of the first electrode plate 110 and the first electrode region 120-1 of the second electrode plate 120.

Further, when the user inputs the second electrode regions 110-2 and 120-2 to the control panel 11, the controller 140 may allow the electric field applier 130 to apply the electric field to the second electrode region 110-2 of the first electrode plate 110 and the second electrode region 120-2 of the second electrode plate 120. However, because it is more difficult to dry a center portion of the object to be dried than an edge portion, the controller 140 may allow the electric field applier 130 to apply the electric field to not only the second electrode regions 110-2 and 120-2, but also the first electrode regions 110-1 and 120-1 corresponding to the center portion.

Further, when the user inputs the third electrode regions 110-3 and 120-3 to the control panel 11, the controller 140 may allow the electric field applier 130 to apply the electric field to the third electrode region 110-3 of the first electrode plate 110 and the third electrode region 120-3 of the second electrode plate 120. However, because it is more difficult to dry a center portion of the object to be dried than an edge portion, the controller 140 may allow the electric field applier 130 to apply the electric field to not only the third electrode regions 110-3 and 120-3, but also the first electrode regions 110-1 and 120-1 and the second electrode regions 110-2 and 120-2, which are more center portions than the third electrode regions 110-3 and 120-3.

As another example, at least one electrode regions 110-1 to 110-3 and 120-1 to 120-3 where the electric field is to be applied may be automatically selected. For this, according to another embodiment, the second drying container 30 of the clothes dryer 1 may further include an impedance detector 150 (refer to FIG. 7).

Figure 7:
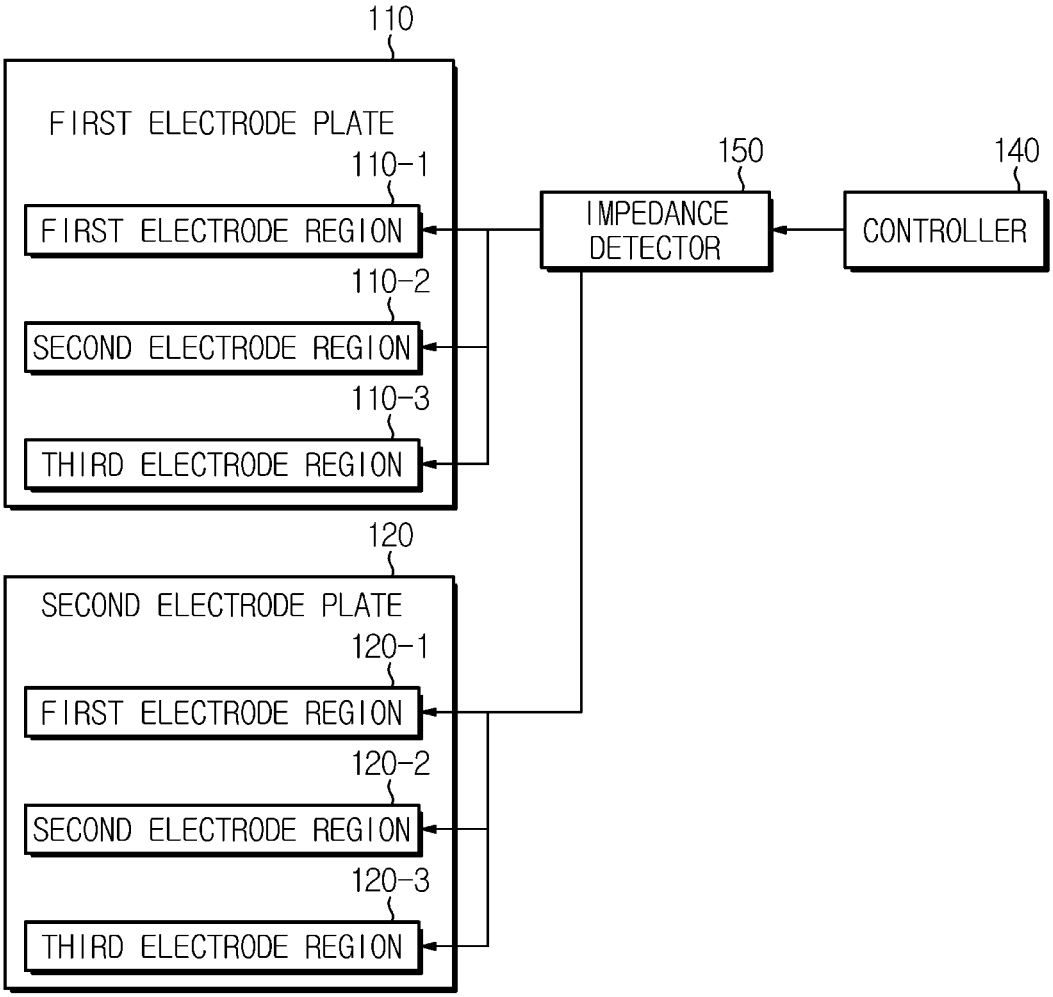
FIG. 7 is a control block diagram of a second drying container of a clothes dryer according to another embodiment of the present disclosure.
Figure 8:
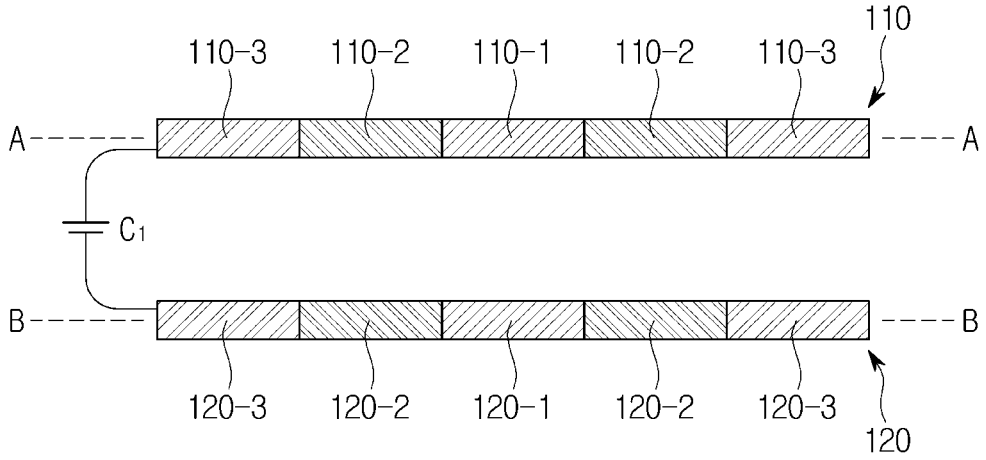
FIG. 8 is a cross-sectional view illustrating a first electrode plate and a second electrode plate, when viewed from a direction A and a direction B in a state in which the second door of FIG. 5 is closed.

FIG. 7 is a control block diagram of a second drying container of a clothes dryer according to another embodiment of the present disclosure and FIG. 8 is a cross-sectional view illustrating a first electrode plate and a second electrode plate, when viewed from a direction A and a direction B in a state in which the second door of FIG. 5 is closed.

The impedance detector 150 detects an impedance of the electrode plates 110 and 120.

Particularly, the impedance detector 150 may detect an impedance C1 between any one region of the first electrode plate 110 and one region of the second electrode plate 120 corresponding to the any one region of the first electrode plate 110, and the controller 140 may select a region of the electrode plates 110 and 120 where the electric field is to be applied, based on the detected impedance C1. The impedance C1 may be inversely proportional to the humidity of the object, which is to be dried, placed between the first electrode plate 110 and the second electrode plate 120.

The impedance detector 150 may detect an impedance C1 between the first electrode region 110-1 of the first electrode plate 110 and the first electrode region 120-1 of the second electrode plate 120, and when the impedance C1 between the first electrode region 110-1 of the first electrode plate 110 and the first electrode region 120-1 of the second electrode plate 120 is less than a predetermined reference value (that is, the object to be dried is less dried), the controller 140 may allow the electric field applier 130 to apply the electric field to the first electrode regions 110-1 and 120-1.

Further, the impedance detector 150 may detect an impedance C1 between the second electrode region 110-2 of the first electrode plate 110 and the second electrode region 120-2 of the second electrode plate 120, and when the impedance C1 between the second electrode region 110-2 of the first electrode plate 110 and the second electrode region 120-2 of the second electrode plate 120 is less than the predetermined reference value (that is, the object to be dried is less dried), the controller 140 may allow the electric field applier 130 to apply the electric field to the second electrode regions 110-2 and 120-2. However, because it is more difficult to dry the center portion of the object to be dried than the edge portion, the controller 140 may allow the electric field applier 130 to apply the electric field to not only the second electrode regions 110-2 and 120-2, but also the first electrode regions 110-1 and 120-1 corresponding to the center portion, when the impedance C1 between the second electrode region 110-2 of the first electrode plate 110 and the second electrode region 120-2 of the second electrode plate 120 is less than the predetermined reference value.

In addition, the impedance detector 150 may detect an impedance C1 between the third electrode region 110-3 of the first electrode plate 110 and the third electrode region 120-3 of the second electrode plate 120, and when the impedance C1 between the third electrode region 110-3 of the first electrode plate 110 and the third electrode region 120-3 of the second electrode plate 120 is less than the predetermined reference value (that is, the object to be dried is less dried), the controller 140 may allow the electric field applier 130 to apply the electric field to the third electrode regions 110-3 and 120-3. However, it is more difficult to dry a center portion of the object to be dried than an edge portion. Therefore, when the impedance C1 between the third electrode region 110-3 of the first electrode plate 110 and the third electrode region 120-3 of the second electrode plate 120 is less than the predetermined reference value, the controller 140 may allow the electric field applier 130 to apply the electric field to not only the third electrode regions 110-3 and 120-3, but also the first electrode regions 110-1 and 120-1 and the second electrode regions 110-2 and 120-2, which are more center portions than the third electrode regions 110-3 and 120-3.

The controller 140 may be implemented with a memory (not shown) configured to store data related to an algorithm to control an operation of components of the clothes dryer 1 or program implementing the algorithm, and a processor (not shown) configured to perform the above mentioned operation using data stored in the memory. The memory and the processor may be implemented as separate chips. Alternatively, the memory and processor may be implemented on a single chip.

Figure 9:
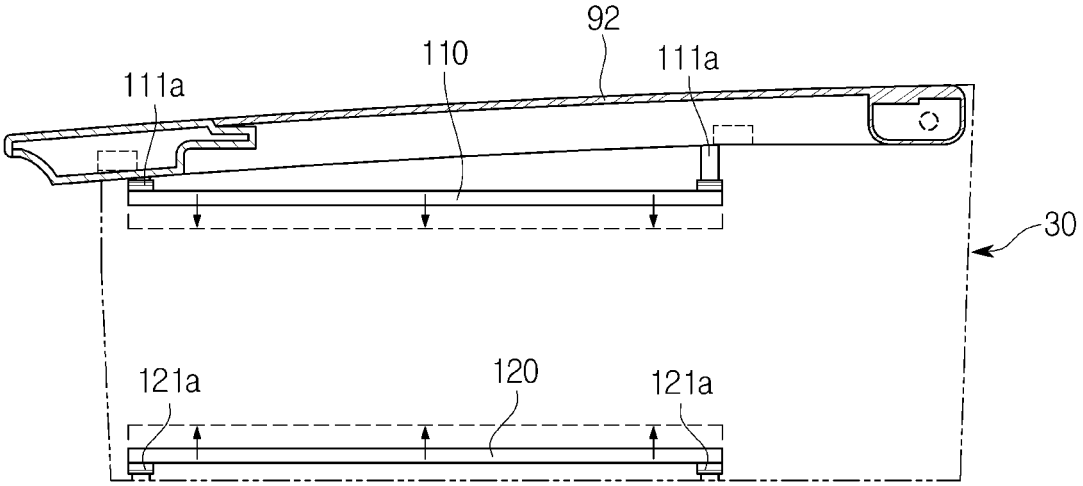
FIG. 9 is a side cross-sectional view of a second drying container of a clothes dryer according to still another embodiment of the present disclosure.
Figure 10:
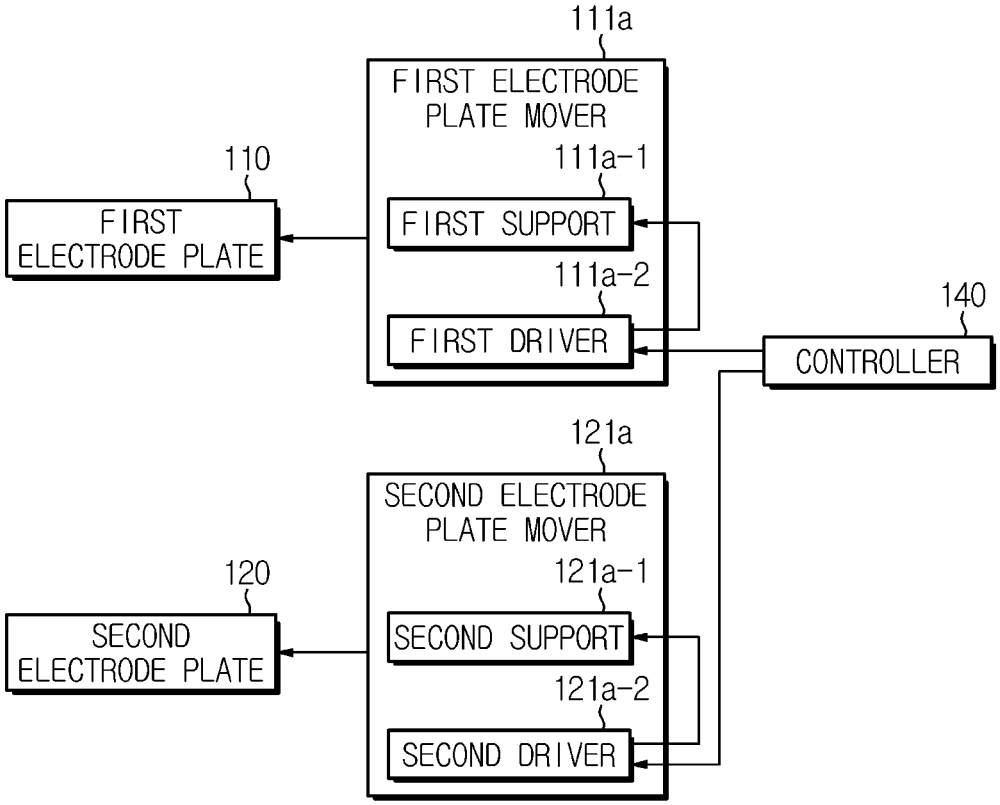
FIG. 10 is a control block diagram of a second drying container of the clothes dryer according to still another embodiment of the present disclosure.

FIG. 9 is a side cross-sectional view of a second drying container of a clothes dryer according to still another embodiment of the present disclosure, and FIG. 10 is a control block diagram of a second drying container of a clothes dryer according to still another embodiment of the present disclosure.

The drying efficiency of the electrode plates 110 and 120 may vary according to a distance between the electrode plates 110 and 120 and the object to be dried, or a distance between the electrode plates 110 and 120. In order to acquire the proper drying efficiency, the second drying container 30 of the clothes dryer 1 according to still another embodiment may further include electrode plate movers 111*a* and 121*a* configured to move the electrode plates 110 and 120.

The electrode plate movers 111*a* and 121*a* may include supports 111*a*-1 and 121*a*-1 configured to connect the electrode plates 110 and 120 to a lower surface of a second door 92, and drivers 111*a*-2 and 121*a*-2 configured to provide a driving force to the supports 111*a*-1 and 121*a*-1 according to a control signal of the controller 140 so as to move the electrode plates 110 and 120 up and down, but components of the electrode plate movers 111*a* and 121*a* are not limited thereto. Therefore, the electrode plate movers 111*a* and 121*a* may include various components configured to move the electrode plates 110 and 120.

The supports 111*a*-1 and 121*a*-1 may include a piston and a cylinder and perform the up and down movement due to the reciprocating of the piston about the cylinder.

Alternatively, the supports 111*a*-1 and 121*a*-1 may be implemented with a male screw and perform the up and down movement due to the reciprocating of the male screw about a female screw of the second door 92. However, the implementation of the support is not limited thereto, and thus the support may be implemented in various components capable of moving up and down.

The supports 111*a*-1 and 121*a*-1 may be omitted. When the supports 111*a*-1 and 121*a*-1 are omitted, the electrode plates 110 and 120 may be directly attached to the second drying container 30 and perform the up and down movement by the drivers 111*a*-2 and 121*a*-2.

The drivers 111*a*-2 and 121*a*-2 may be various devices, such as a motor or an actuator, capable of providing a driving force according to an electrical signal.

According to still another embodiment, the controller 140 determines whether to move the electrode plates 110 and 120 or identifies an amount of movement, and generates a control signal to control the drivers 111*a*-2 and 121*a*-2 based on whether to move the electrode plates 110 and 120 or the amount of movement of the electrode plates 110 and 120.

As an example, whether to move the electrode plates 110 and 120 may be manually received through the control panel 11. When a user inputs a distance reduce command to the control panel 11, the controller 140 may move the first electrode plate 110 downward by a predetermined distance and move the second electrode plate 120 upward by a predetermined distance. In contrast, when the user inputs a distance increase command to the control panel 11, the controller 140 may move the first electrode plate 110 upward by a predetermined distance and move the second electrode plate 120 downward by a predetermined distance.

The amount of movement of the electrode plates 110 and 120 may also be received manually through the control panel 11. When a user inputs a "distance reduce" command to the control panel 11, the controller 140 may move the first electrode plate 110 downward and move the second electrode plate 120 upward during the user inputs the distance reduce command. In contrast, when a user inputs a "distance increase" command to the control panel 11, the controller 140 may move the first electrode plate 110 upward and move the second electrode plate 120 downward during the user inputs the distance increase command.

As another example, whether to move the electrode plates 110 and 120 or the amount of movement of the electrode plates 110 and 120 may be automatically selected. For this, according to still another embodiment, the second drying container 30 of the clothes dryer 1 may further include an impedance detector 150 (refer to FIG. 11).

Figure 11:
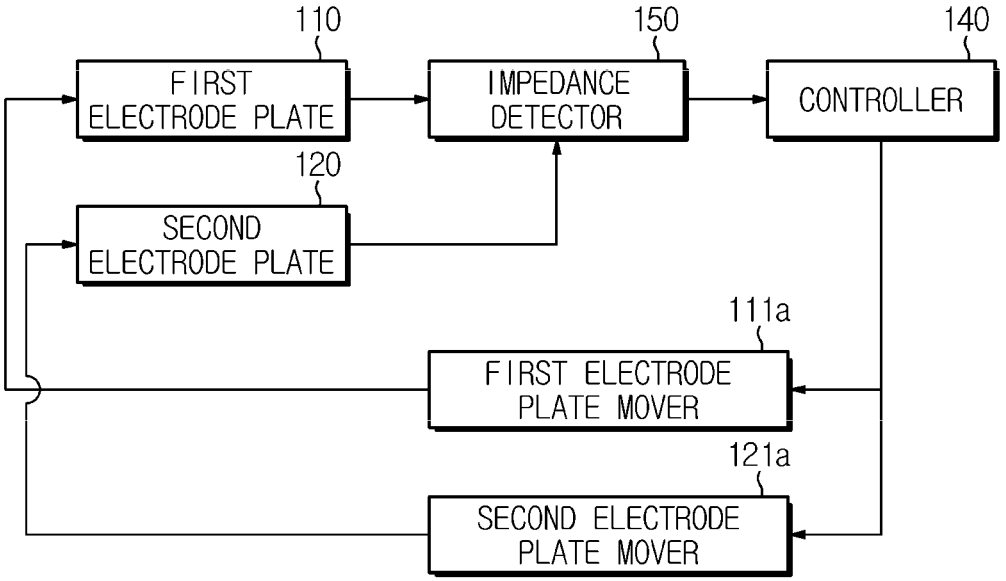
FIG. 11 is a control block diagram of a second drying container of a clothes dryer according to still another embodiment of the present disclosure.

FIG. 11 is a control block diagram of a second drying container of a clothes dryer according to still another embodiment of the present disclosure. An impedance detector 150 of FIG. 11 may be the same as the impedance detector 150 of the clothes dryer 1 according another embodiment described with reference to FIG. 7.

The impedance detector 150 detects an impedance of the electrode plates 110 and 120. The impedance may vary according to the volume or humidity of the object to be dried in a second drying container.

Particularly, the impedance detector 150 may detect an impedance between any one region of the first electrode plate 110 and one region of the second electrode plate 120 corresponding to the any one region of the first electrode plate 110, and the controller 140 may move the first electrode plate 110 and the second electrode plate 110 until the detected impedance has a value in a predetermined range.

For example, in a condition in which the predetermined range has a maximum value and a minimum value, the controller 140 may adjust a distance between the first electrode plate 110 and the second electrode plate 120 so that the detected impedance has a value equal to or greater than the minimum value and equal to or less than the maximum value.

According to the above-mentioned embodiment, the second drying container 30 includes two electrode plates 110 and 120, but the number of the electrode plate is not limited thereto. Therefore, the second drying container 30 may be provided with one or three or more electrode plates.

Figure 12:
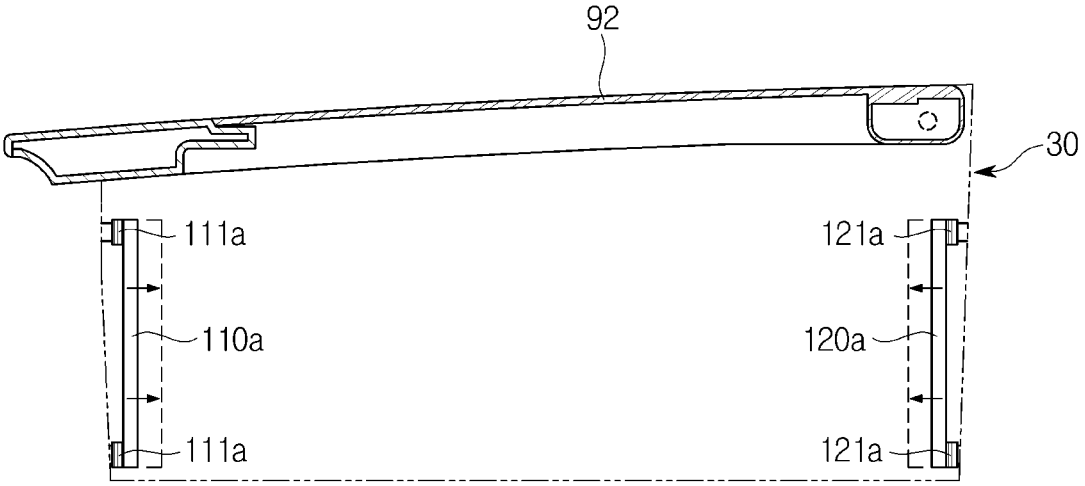
FIG. 12 is a side cross-sectional view of a second drying container of a clothes dryer according to still another embodiment of the present disclosure.

Further, according to the above-mentioned embodiment, the first electrode plate 110 is installed on the lower surface of the upper portion of the second drying container 30 and the second electrode plate 120 is installed on the upper surface of the lower portion of the second drying container 30, but the position of the first electrode plate 110 and the second electrode plate 120 is not limited thereto. FIG. 12 is a side cross-sectional view of a second drying container of a clothes dryer according to still another embodiment of the present disclosure.

Referring to FIG. 12, a first electrode plate 110*a* may be installed on a left surface of a second drying container 30, and a second electrode plate 120*a* may be installed on a right surface of the second drying container 30.

In the same manner, according to still another embodiment, the second drying container 30 of the clothes dryer 1 may further include electrode plate movers 111*a* and 121*a* configured to move the electrode plates 110*a* and 120*a*. The electrode plate movers 111*a* and 121*a* may move the first electrode plate 110*a* and the second electrode plate 120*a* in the left and right side. A distance between the first electrode plate 110*a* and the second electrode plate 120*a* may be changed by moving the first electrode plate 110*a* and the second electrode plate 120*a* in the left and right side. The description of the electrode plate movers 111*a* and 121*a* has been described with reference to FIGS. 9 and 10, and a duplicated description thereof will be omitted.

Figure 13A:
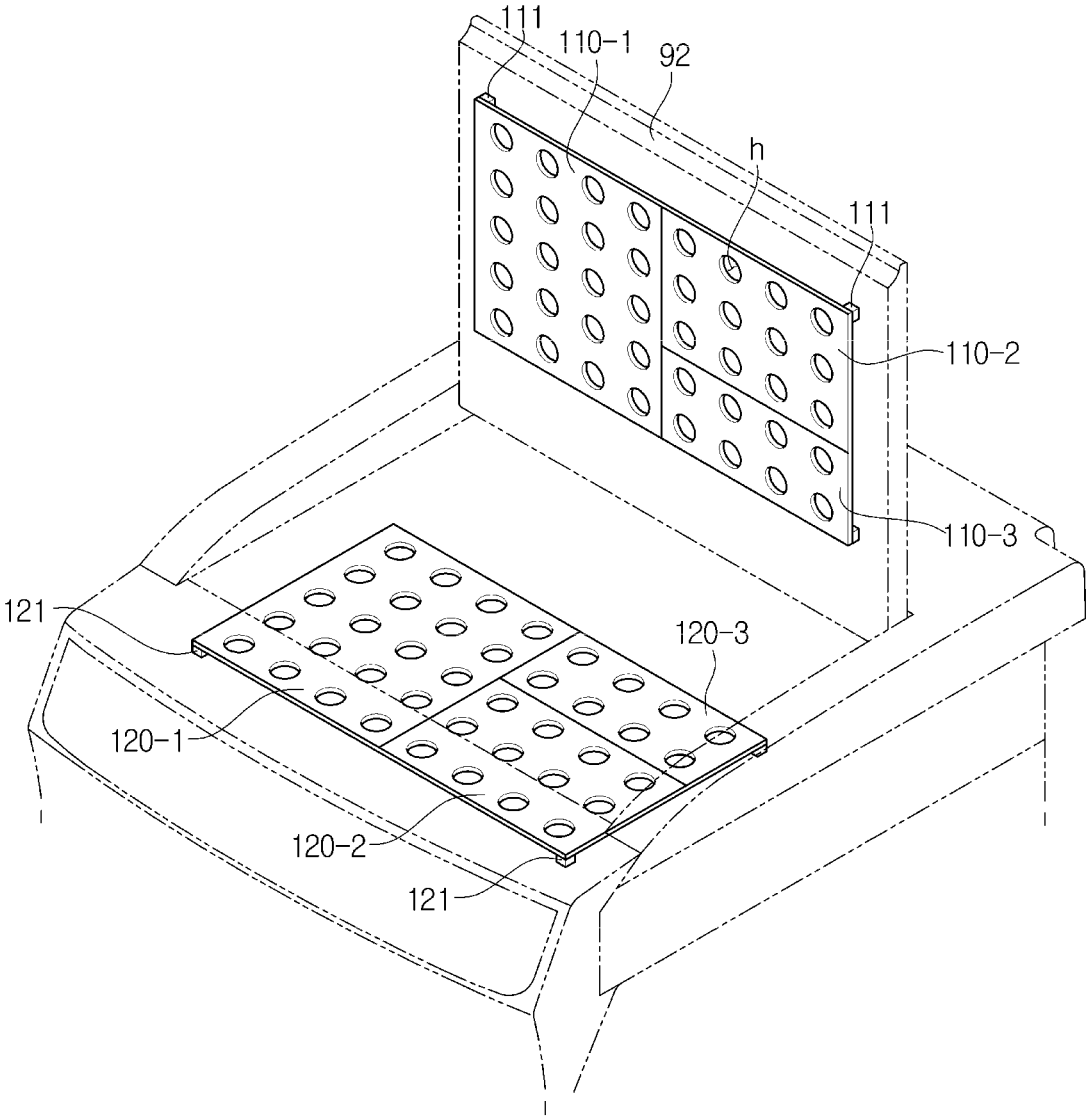
FIGS. 13A and 13B are views illustrating a state in which a second door of a clothes dryer according to still another embodiment of the present disclosure is opened.
Figure 13B:
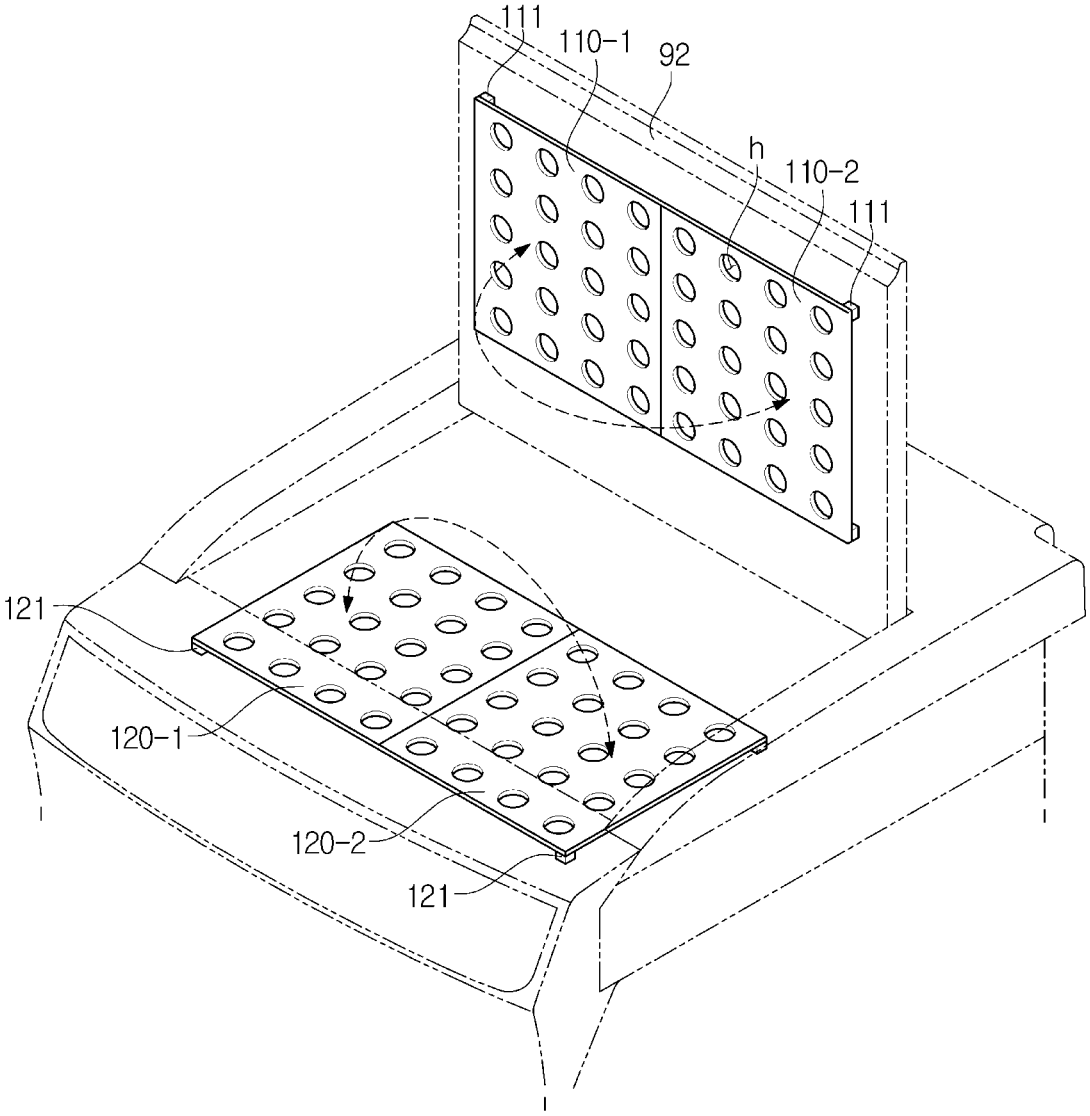

According to the above-mentioned embodiment, the plurality of regions contained in the electrode plates 110 and 120 may include first electrode regions 110-1 and 120-1 arranged at the center of the electrode plates 110 and 120, and second electrode regions 110-2 and 120-2 surrounding the outside of the first electrode regions 110-1 and 120-1, and may further include third electrode regions 110-3 and 120-3 surrounding the outside of the second electrode regions 110-2 and 120-2, but the arrangement of the plurality of regions is not limited thereto. FIGS. 13A and 13B are views illustrating a state in which a second door of a clothes dryer according to still another embodiment of the present disclosure is opened.

Referring to FIG. 13A, according to still another embodiment, a first electrode plate 110 and a second electrode plate 120 of a clothes dryer 1 may include a plurality of regions, respectively. The plurality of regions may include first electrode regions 110-1 and 120-1 occupying the largest area of the plates 110 and 120, and second electrode regions 110-2 and 120-2 occupying the second largest area following the first electrode regions 110-1 and 120-1, and may further include third electrode regions 110-3 and 120-3 occupying the smallest area. The arrangement of the first electrode regions 110-1 and 120-1 to the third electrode regions 110-3 and 120-3 may be different from that of FIG. 13A. A user may put an object to be dried having the largest size on the first electrode regions 110-1 and 120-1, and put an object to be dried, which has a proper size for the second electrode regions 110-2 and 120-2 and the third electrode regions 110-3 and 120-3, on the second electrode regions 110-2 and 120-2 or the third electrode regions 110-3. In the same manner as the above mentioned embodiment, the electrode plates 110 and 120 may include a plurality of hole h, respectively.

In addition, referring to FIG. 13B, according to still another embodiment, electrode plates 110 and 120 of a clothes dryer 1 include a first electrode plate 110 and a second electrode plate 120, and the first and second electrode plates 110 and 120 may be manually or automatically foldable. When the electrode plates 110 and 120 are folded, first electrode regions 110-1 and 120-1 and second electrode regions 110-2 and 120-2 may operate as one electrode region. In the same manner as the above mentioned embodiment, the electrode plates 110 and 120 may include a plurality of hole h, respectively.

Figure 14:
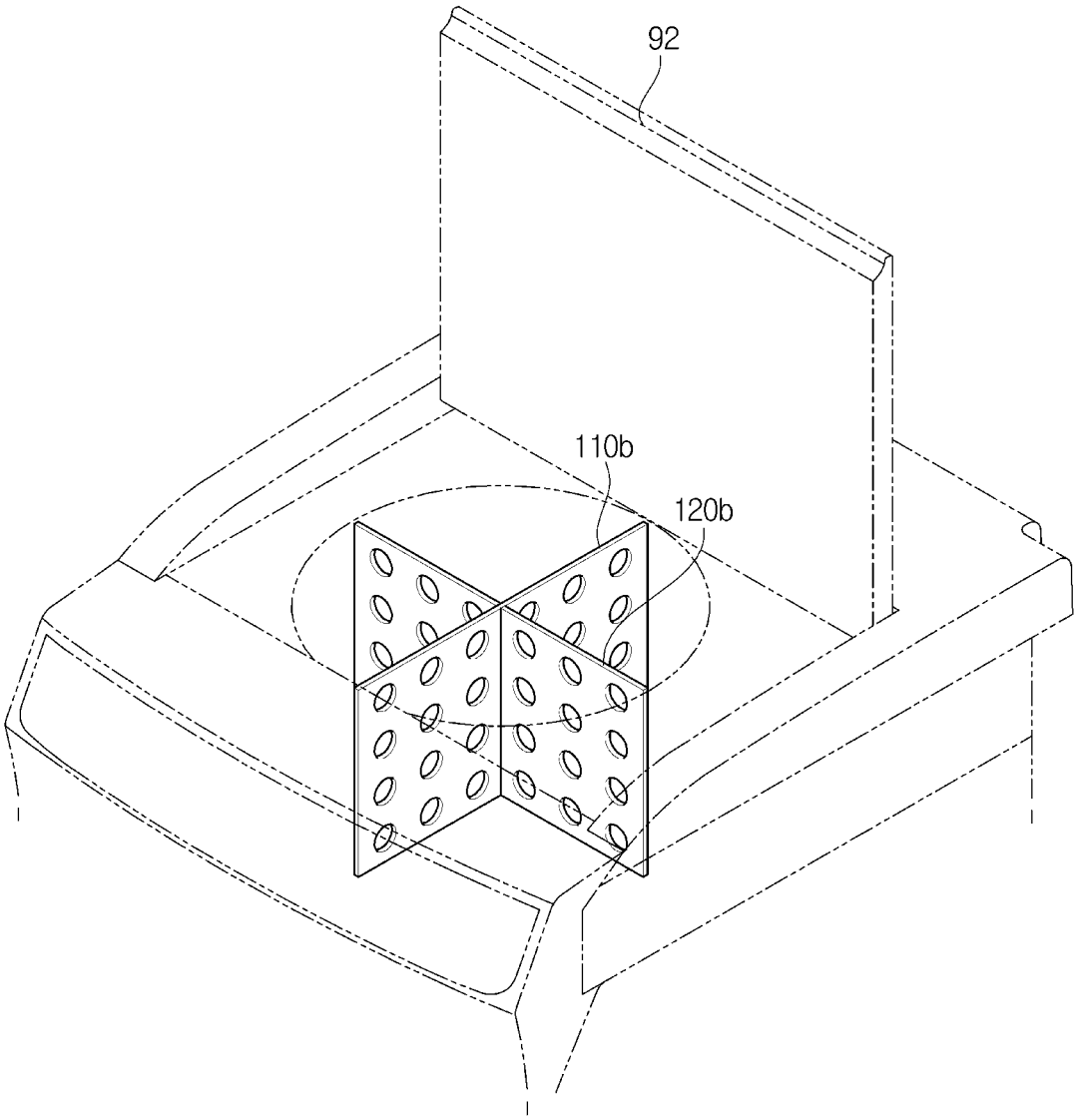
FIGS. 14 and 15 are views illustrating various examples of an arrangement of an electrode plate of a clothes dryer according still another embodiment of the present disclosure.
Figure 15:
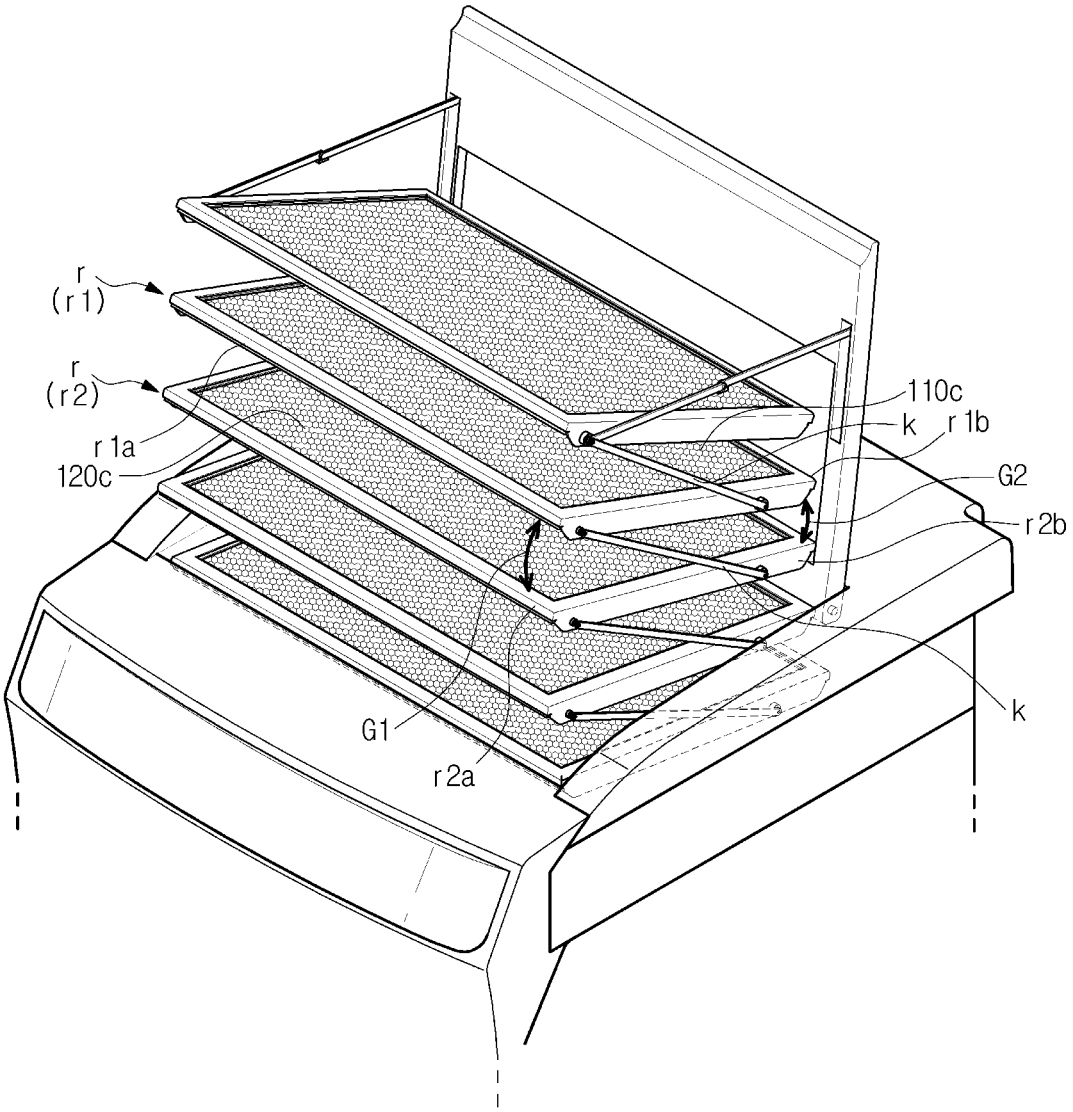

According to the above-mentioned embodiment, the first electrode plate 110 of the second drying container 30 is installed on one surface of the second drying container 30, and the second electrode plate 120 is installed on other surface of the second drying container 30 facing the first electrode plate 110, the position of the first electrode plate 110 and the second electrode plate 120 is not limited thereto. FIGS. 14 and 15 are views illustrating various examples of an arrangement of an electrode plate of a clothes dryer according still another embodiment of the present disclosure.

Referring to FIG. 14, according to still another embodiment, electrode plates 110*b* and 120*b* may intersect to have a propeller shape with respect to an upper surface of a second drying container 30.

That is, the first electrode plate 110*b* and the second electrode plate 120*b* intersect with each other and the first electrode plate 110*b* may be formed of cathodes and the second electrode plate 120*b* may be formed of anodes. Accordingly, it may be possible to apply an electric field to an object to be dried between the first electrode plate 110*b* and the second electrode plate 120*b*.

The first electrode plate 110*b* and the second electrode plate 120*b* may rotate clockwise or counterclockwise in the second drying container 30.

FIG. 14 illustrates that two electrode plates 110*b* and 120*b* are provided, but the number of the electrode plate is not limited thereto. Therefore, three or more electrode plates may be provided and electrode plates adjacent to each other have different polarities.

Referring to FIG. 15, according to still another embodiment, electrode plates 110*b* and 120*b* may be installed on at least one rack r among a plurality of racks r in the form of bellows.

The rack r includes a first rack ra and a second rack r2 installed in the lower side of the first rack ra. When a second door 92 is opened, the first rack r1 and the second rack r2 may move upward. Particularly, a gap G1 between a front end r1*a* of the first rack ra and a front end r2*a* of the second rack r2 may be greater than a gap G2 between a rear end r1*b* of the first rack ra and a rear end r2*b* of the second rack r2.

The first rack r1 and second rack r2 may be coupled via a link member k. The link member k may connect the front end of the first rack ra to the rear end of the second rack r2.

As illustrated in FIG. 15, when the first rack r1 is raised, the front end of the link member k is raised.

A first electrode plate 110*c* and a second electrode plate 120 may be installed on the first rack r1 and the second rack r2, respectively. The racks r1 and r2 adjacent to each other may have different electrodes. For example, when the first electrode plate 110*c* is composed of cathodes, the second electrode plate 120 may be composed of anodes. Alternatively, when the first electrode plate 110*c* is composed of anodes, the second electrode plate 120 may be composed of cathodes.

Other than the electrode plate illustrated in FIGS. 14 and 15, a plurality of electrode plates configured to divide an empty space of the second drying container 30 into a plurality of regions may be employed.

At least one component may be added or omitted in accordance with performance of the components of the clothes dryer 1 illustrated in FIGS. 1 to 15. It will be readily understood by those skilled in the art that the mutual position of the components can be changed corresponding to the performance or structure of the system.

Some of the component illustrated in FIGS. 6, 7, 10, and 11 may be software component and/or hardware component such as Field Programmable Gate Array (FPGA) and application specific integrated circuit (ASIC).

While the present disclosure has been particularly described with reference to exemplary embodiments, it should be understood by those of skilled in the art that various changes in form and details may be made without departing from the spirit and scope of the present disclosure.

The invention claimed is:

1. A clothes dryer comprising:

a body;

a first drying container installed in the body and configured to include a rotary drum configured to be rotatable; and a second drying container installed in the body but separated from the first drying container, the second drying container comprising an electrode plate including a first electrode plate installed on one surface of the second drying container and a second electrode plate installed on another surface of the second drying container facing the first electrode plate, the electrode plate including a plurality of electrode regions;

a controller configured to select an electrode region where an electric field is to be applied, among the plurality of electrode regions; and an electric field applier configured to apply an electric field to the electrode region selected by the controller.

2. The clothes dryer of claim 1, wherein, the second drying container further comprises a door configured to open and close an inlet formed in an upper surface of the second drying container, and the first electrode plate is installed on a lower surface of the door, and the second electrode plate is installed on an upper surface of a lower portion of the second drying container.

3. The clothes dryer of claim 2, wherein, the first electrode plate is formed of cathodes and the second electrode plate is formed of anodes.

4. The clothes dryer of claim 1, wherein, the electrode plate comprises a first electrode region arranged in a center portion of the electrode plate and a second electrode region surrounding an outside of the first electrode region.

5. The clothes dryer of claim 1, wherein, the second drying container further comprises an impedance detector configured to detect an impedance of the plurality of electrode regions, wherein the controller selects an electrode region where an electric field is to be applied, based on the impedance of the plurality of electrode regions.

6. The clothes dryer of claim 5, wherein, the electrode plate comprises a first electrode region arranged in a center portion of the electrode plate and a second electrode region surrounding an outside of the first electrode region, wherein the controller allows the electric field applier to apply an electric field to the first electrode region when a capacitance of the first electrode region is less than a predetermined reference value, and the controller allows the electric field applier to apply an electric field to the first electrode region and the second electrode region when a capacitance of the second electrode region is less than the predetermined reference value.

7. The clothes dryer of claim 1, further comprising:

a control panel configured to receive a command for applying an electric field to at least one electrode region among the plurality of electrode regions, from a user, wherein the controller selects an electrode region where an electric field is to be applied, based on the electric field application command.

8. The clothes dryer of claim 1, wherein, the second drying container further comprises an electrode plate mover configured to move the electrode plate.

9. The clothes dryer of claim 8, wherein, the second drying container further comprises an impedance detector configured to detect an impedance of the electrode plate, wherein the controller controls the electrode plate mover based on a value detected by the impedance detector.

10. The clothes dryer of claim 8, further comprising:

a control panel configured to receive an electrode plate movement command, from a user, wherein the controller allows the electrode plate mover to move the electrode plate based on the electrode plate movement command.

11. The clothes dryer of claim 1, wherein, the electrode plate comprises a plurality of holes.

12. The clothes dryer of claim 1, wherein, the electrode plate is installed on a side surface of the second drying container.

13. The clothes dryer of claim 1, wherein, the electrode plate comprises a plurality of electrode plates configured to divide an empty space of the second drying container into a plurality of regions.

14. The clothes dryer of claim 13, wherein, the plurality of electrode plates is formed in the form of a propeller with respect to an upper surface of the second drying container.

* * * * *